US010254030B2

(12) United States Patent
Kawashima et al.

(10) Patent No.: US 10,254,030 B2
(45) Date of Patent: Apr. 9, 2019

(54) REFRIGERATION CYCLE DEVICE

(71) Applicant: Mitsubishi Electric Corporation, Tokyo (JP)

(72) Inventors: Mitsuru Kawashima, Tokyo (JP); Akira Maeda, Tokyo (JP); Takao Komai, Tokyo (JP); Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/501,895

(22) PCT Filed: Sep. 26, 2014

(86) PCT No.: PCT/JP2014/075670
§ 371 (c)(1),
(2) Date: Feb. 6, 2017

(87) PCT Pub. No.: WO2016/046964
PCT Pub. Date: Mar. 31, 2016

(65) Prior Publication Data

US 2017/0234592 A1 Aug. 17, 2017

(51) Int. Cl.
*F24F 1/0011* (2019.01)
*F25B 49/02* (2006.01)
(Continued)

(52) U.S. Cl.
CPC ..... *F25B 49/02* (2013.01); *F24F 13/06* (2013.01); *F24F 13/08* (2013.01); *F24F 13/10* (2013.01);
(Continued)

(58) Field of Classification Search
CPC ..... F25B 49/02; F25B 13/00; F25B 2400/12
See application file for complete search history.

(56) References Cited

U.S. PATENT DOCUMENTS

2002/0178738 A1* 12/2002 Taira ..... F25B 49/005 62/129
2009/0229289 A1* 9/2009 Ohmae ..... F24F 1/0007 62/259.1
2014/0053591 A1 2/2014 Shin et al.

FOREIGN PATENT DOCUMENTS

JP H09-324928 A 12/1997
JP H11-304626 A 11/1999
(Continued)

OTHER PUBLICATIONS

Office action dated Oct. 24, 2017 in the corresponding EP patent application No. 14 902 477.0.
(Continued)

*Primary Examiner* — Emmanuel Duke
(74) *Attorney, Agent, or Firm* — Posz Law Group, PLC

(57) ABSTRACT

A refrigeration cycle device uses a refrigerant having a higher concentration than air under atmospheric pressure, and is capable of preventing a region having a certain refrigerant concentration or higher from being formed even if the refrigerant leaks in a casing of the refrigeration cycle device in a nonenergized state. The refrigeration cycle device includes: a casing having a first opening and a second opening, one of which is an inlet and the other of which is an outlet, and having therein an air course providing communication between the first opening and the second opening; and a refrigerant circuit provided in the air course in the casing and filled with a refrigerant having a higher concentration than air under atmospheric pressure, the casing having a third opening providing communication between the air course and outside of the casing.

12 Claims, 9 Drawing Sheets

(51) Int. Cl.

| | |
|---|---|
| ***F24F 13/20*** | (2006.01) |
| ***F25B 13/00*** | (2006.01) |
| ***F24F 13/06*** | (2006.01) |
| ***F24F 13/08*** | (2006.01) |
| ***F24F 13/10*** | (2006.01) |
| *F24F 11/36* | (2018.01) |

(52) U.S. Cl.
CPC ..... *F24F 13/20* (2013.01); *F25B 13/00* (2013.01); *F24F 11/36* (2018.01); *F25B 2400/12* (2013.01)

(56) References Cited

FOREIGN PATENT DOCUMENTS

| | | | | |
|---|---|---|---|---|
| JP | 2001-263919 | A | | 9/2001 |
| JP | 2002-098346 | A | | 4/2002 |
| JP | 2002-098393 | A | | 4/2002 |
| JP | 2002-115939 | A | | 4/2002 |
| JP | 2002-188878 | A | | 7/2002 |
| JP | 2002188878 | A | * | 7/2002 |
| JP | 2005069652 | | * | 3/2005 |
| JP | 2011-127847 | A | | 6/2011 |

OTHER PUBLICATIONS

International Preliminary Report on Patentability of Apr. 6, 2017 in the corresponding international application No. PCT/JP2014/075670.

International Search Report of the International Searching Authority dated Dec. 22, 2014 for the corresponding international application No. PCT/JP2014/075670 (and English translation).

* cited by examiner

REFRIGERATION CYCLE DEVICE

CROSS REFERENCE TO RELATED APPLICATION

This application is a U.S. national stage application of International Application No. PCT/JP2014/075670 filed on Sep. 26, 2014, the disclosure of which is incorporated herein by reference.

FIELD

The present invention relates to a refrigeration cycle device.

BACKGROUND

A known conventional refrigeration cycle device includes: an indoor unit in which a casing having an inlet and an outlet houses a heat exchanger and a fan; and a sensor that is provided on an outer surface of the casing of the indoor unit and detects a refrigerant gas, wherein when the sensor detects the refrigerant gas, a control portion performs control to rotate the fan (for example, see PTL 1).

CITATION LIST

Patent Literature

[PTL 1] JP 2002-098393 A

SUMMARY

Technical Problem

However, the conventional refrigeration cycle device disclosed in PTL 1 requires power for operating the sensor and the fan when detecting a leak of a refrigerant. Thus, the refrigeration cycle device does not function if the refrigerant leaks in a situation where the refrigeration cycle device is not energized such as when stored in a warehouse or the like, when repaired, or when relocated.

For this reason, if the refrigerant leaks from a refrigerant pipe or the like in the casing of the refrigeration cycle device in a nonenergized state and the leaking refrigerant flows out into a room or the like, a region having a certain refrigerant concentration or higher may be formed in the room or the like.

The present invention is achieved to solve such a problem, and has an object to provide a refrigeration cycle device that uses a refrigerant having a higher concentration than air under atmospheric pressure, and is capable of preventing a region having a certain refrigerant concentration or higher from being formed even if the refrigerant leaks from a refrigerant pipe or the like in a casing of the refrigeration cycle device in a nonenergized state and the leaking refrigerant flows out of the casing.

Solution to Problem

A refrigeration cycle device according to the present invention includes: a casing having a first opening and a second opening, one of which is an inlet and the other of which is an outlet, and having therein an air course providing communication between the first opening and the second opening; and a refrigerant circuit provided in the air course in the casing and filled with a refrigerant having a higher concentration than air under atmospheric pressure, the casing having a third opening providing communication between the air course and outside of the casing, the third opening being arranged below the refrigerant circuit, and a lower edge of the third opening being located below lower edges of the first opening and the second opening, the refrigeration cycle device further comprising diffusion means configured to diffuse the refrigerant leaking from the refrigerant circuit and flowing from the air course through the third opening out of the casing.

Advantageous Effects of Invention

The refrigeration cycle device according to the present invention has an advantage that the refrigeration cycle device uses a refrigerant having a higher concentration than air under atmospheric pressure, and is capable of preventing a region having a certain refrigerant concentration or higher from being formed even if the refrigerant leaks from a refrigerant pipe or the like in a casing of the refrigeration cycle device in a nonenergized state and the leaking refrigerant flows out of the casing.

DESCRIPTION OF EMBODIMENTS

Figure 1:
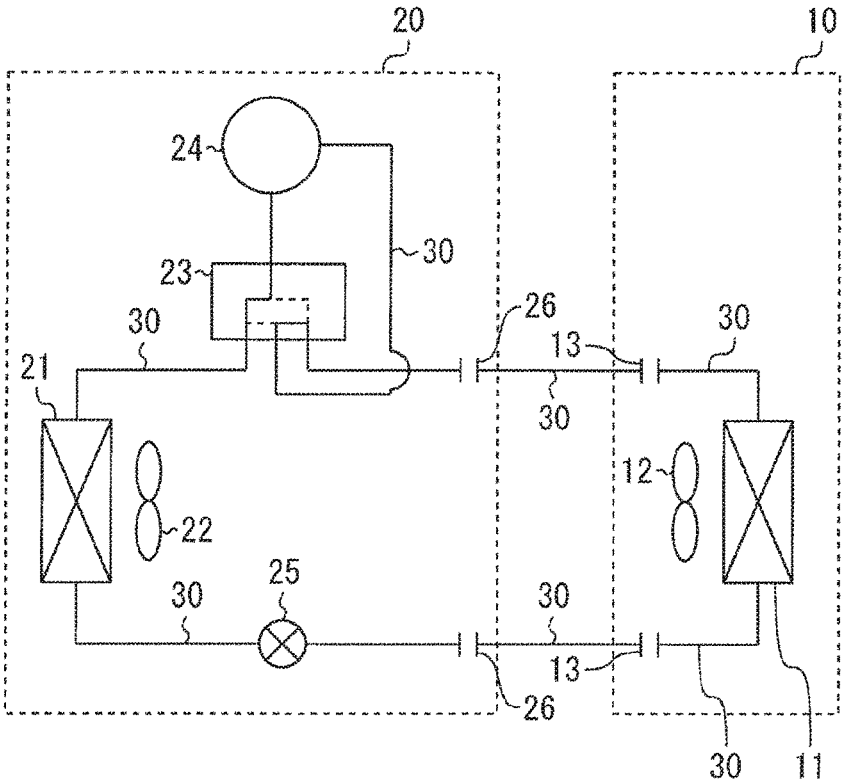
FIG. 1 shows an overall configuration of an air conditioner as an example of a refrigeration cycle device related to Embodiment 1 of the present invention.

The present invention will be described with reference to the accompanying drawings. Throughout the drawings, like reference numerals denote like or corresponding components, and overlapping descriptions thereof will be simplified or omitted as appropriate.

Embodiment 1

Figure 2:
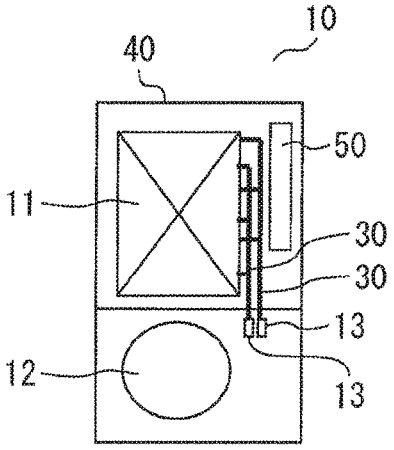
FIG. 2 is a front view of an internal configuration of an indoor unit of the air conditioner as an example of the refrigeration cycle device related to Embodiment 1 of the present invention.
Figure 3:
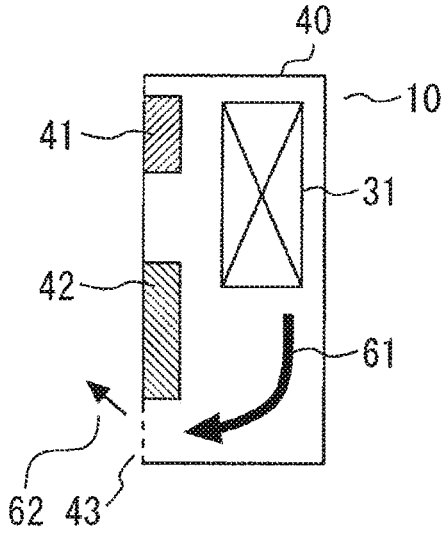
FIG. 3 is a sectional view of the indoor unit of the air conditioner as an example of the refrigeration cycle device related to Embodiment 1 of the present invention seen from the side.
Figure 4:
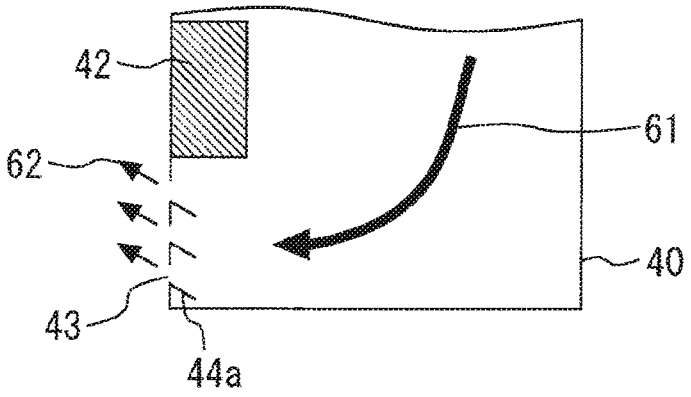
FIG. 4 is an enlarged view of essential portions of FIG. 3.
Figure 5:
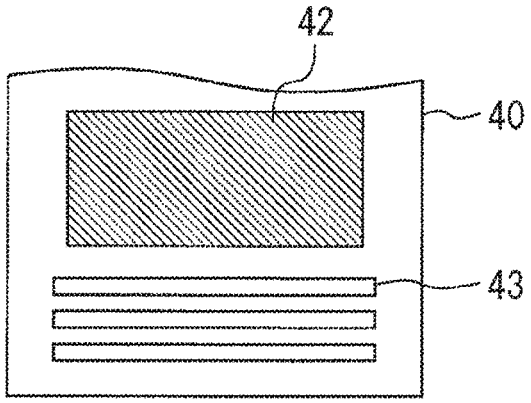
FIG. 5 is an example of a front view of the essential portions shown in FIG. 4 in an enlarged manner.
Figure 6:
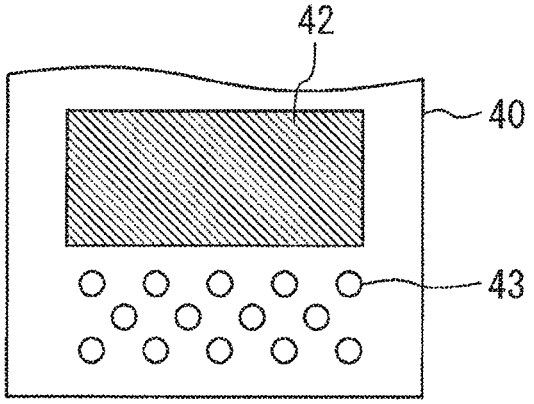
FIG. 6 is another example of a front view of the essential portions shown in FIG. 4 in an enlarged manner.

FIGS. 1 to 6 relate to Embodiment 1 of the present invention, FIG. 1 shows an overall configuration of an air conditioner as an example of a refrigeration cycle device, FIG. 2 is a front view of an internal configuration of an indoor unit of the air conditioner as an example of the refrigeration cycle device, FIG. 3 is a sectional view of the indoor unit of the air conditioner as an example of the refrigeration cycle device seen from the side, FIG. 4 is an enlarged view of essential portions of FIG. 3, FIG. 5 is an example of a front view of the essential portions shown in FIG. 4 in an enlarged manner, and FIG. 6 is another example of a front view of the essential portions shown in FIG. 4 in an enlarged manner.

FIG. 1 shows a configuration of an air conditioner as an example of a refrigeration cycle device according to the present invention. A refrigeration cycle device to which a refrigerant leak detection device according to the present invention is applied may include, for example, a water heater, a showcase, or a refrigerator, other than the air conditioner.

As shown in FIG. 1, the air conditioner includes an indoor unit 10 and an outdoor unit 20. The indoor unit 10 is installed in a room to be air-conditioned. The outdoor unit 20 is installed outside the room. The indoor unit 10 includes an indoor unit heat exchanger 11 and an indoor unit fan 12. The outdoor unit 20 includes an outdoor unit heat exchanger 21 and an outdoor unit fan 22. The indoor unit 10 and the outdoor unit 20 are connected by a refrigerant pipe 30. The refrigerant pipe 30 is circularly provided between the indoor unit heat exchanger 11 and the outdoor unit heat exchanger 21. The refrigerant pipe 30 is filled with a refrigerant.

The refrigerant gas filling the refrigerant pipe 30 desirably has a low global warming potential (GWP) in terms of global environment. Also, the refrigerant gas filling the refrigerant pipe 30 is a flammable gas. The refrigerant has a higher concentration than air under atmospheric pressure, and has a property of falling down in air in a direction of gravitational force.

Such a refrigerant includes, specifically for example, a (mixed) refrigerant consisting of one or more refrigerants selected from tetrafluoropropene (CF3CF═CH2:HFO-1234yf), difluoromethane (CH2F2:R32), propane (R290), propylene (R1270), ethane (R170), butane (R600), isobutane (R600a), 1.3.3.3-tetrafluoro-1-propene (CF3-CH═CHF:HFO-1234ze), or the like.

In the refrigerant pipe 30 on one side of a refrigerant circulation path between the indoor unit heat exchanger 11 and the outdoor unit heat exchanger 21, a compressor 24 is provided via a four-way valve 23. The compressor 24 is a device for compressing a supplied refrigerant to increase pressure and temperature of the refrigerant. As the compressor 24, for example, a rotary compressor, a scroll compressor, or the like may be used. In the refrigerant pipe 30 on the other side of the circulation path, an expansion valve 25 is provided. The expansion valve 25 expands a flowing refrigerant to reduce pressure of the refrigerant. The four-way valve 23, the compressor 24, and the expansion valve 25 are provided in the outdoor unit 20.

The refrigerant pipe 30 on the side of the indoor unit 10 and the refrigerant pipe 30 on the side of the outdoor unit 20 are connected by a metal joint such as a coupling. Specifically, an indoor unit metal joint 13 is provided in the refrigerant pipe 30 in the indoor unit 10. An outdoor unit metal joint 26 is provided in the refrigerant pipe 30 in the outdoor unit 20. Via the refrigerant pipe 30 between the indoor unit metal joint 13 and the outdoor unit metal joint 26, the refrigerant pipe 30 on the side of the indoor unit 10 and the refrigerant pipe 30 on the side of the outdoor unit 20 are connected to form the refrigerant circulation path.

The refrigerant circulation path formed by the refrigerant pipe 30 as well as the indoor unit heat exchanger 11, the outdoor unit heat exchanger 21, the four-way valve 23, the compressor 24, and the expansion valve 25 connected on the circulation path by the refrigerant pipe 30 constitute a refrigeration cycle.

The refrigeration cycle thus configured serves as a heat pump that performs heat exchange between the refrigerant and air in each of the indoor unit heat exchanger 11 and the outdoor unit heat exchanger 21 to move heat between the indoor unit 10 and the outdoor unit 20. In this case, switching the four-way valve 23 can reverse a refrigerant circulation direction in the refrigeration cycle to switch between a cooling operation and a heating operation.

Hereinafter, a part or the whole of the refrigeration cycle thus configured is referred to as a refrigerant circuit. Specifically, the refrigerant circuit refers to a part or all of the refrigerant pipe 30, the indoor unit heat exchanger 11, the outdoor unit heat exchanger 21, the four-way valve 23, the compressor 24, the expansion valve 25, the indoor unit metal joint 13, and the outdoor unit metal joint 26.

The indoor unit 10 and the outdoor unit 20 each have a casing. The casing of the indoor unit 10 houses the refrigerant pipe 30 filled with the refrigerant as well as the indoor unit heat exchanger 11, the indoor unit fan 12, and the indoor unit metal joint 13. The casing of the outdoor unit 20 also houses the refrigerant pipe 30 filled with the refrigerant as well as the outdoor unit heat exchanger 21, the outdoor unit fan 22, the four-way valve 23, the compressor 24, the expansion valve 25, and the outdoor unit metal joint 26.

Now, the indoor unit 10 will be particularly described. As shown in FIG. 2, the indoor unit 10 includes a casing 40. The casing 40 is a case that forms an outer shell of the indoor unit 10. Here, the casing 40 is a substantially rectangular parallelepiped box. The indoor unit 10 is a so-called "floor-type" indoor unit placed, for example, on a floor surface of the room for use.

As described above, the indoor unit 10 includes the indoor unit heat exchanger 11 and the indoor unit fan 12. The indoor unit heat exchanger 11 is arranged and housed in an upper position in the casing 40 of the indoor unit 10. The indoor unit fan 12 is arranged and housed in a lower position in the casing 40.

Two refrigerant pipes 30 are arranged on a lateral side of the indoor unit heat exchanger 11 in the casing 40. The refrigerant pipes 30 include a gas pipe through which the filling refrigerant flows in the form of a gas, and a liquid pipe through which the filling refrigerant flows in the form of a liquid. The refrigerant pipes 30 are substantially vertically arranged on the lateral side of the indoor unit heat exchanger 11. One end of each refrigerant pipe 30 is connected to the indoor unit heat exchanger 11. The other end on a lower side of each refrigerant pipe 30 is connected via the indoor unit metal joint 13 to the refrigerant pipe on the side of the outdoor unit 20. The indoor unit metal joint 13 is also housed in the casing 40.

The casing 40 also houses an electronic circuit substrate 50 on which a control circuit for controlling an operation of the indoor unit 10 is mounted.

As shown in FIG. 3, the casing 40 has a first opening 41 and a second opening 42 that provide communication between inside and outside of the casing 40. The first opening 41 and the second opening 42 are here provided in a front surface of the casing 40. One of the first opening 41 and the second opening 42 is an inlet, and the other is an outlet. Here, the first opening 41 arranged in a relatively upper position is an outlet, and the second opening 42 arranged in a relatively lower position is an inlet.

The refrigerant circuit 31 shown in FIG. 3 corresponds to the indoor unit heat exchanger 11, the refrigerant pipe 30, and the indoor unit metal joint 13 in FIG. 2. However, it is only necessary that the refrigerant circuit 31 includes at least the indoor unit heat exchanger 11. The refrigerant circuit 31 is arranged behind the first opening 41 as the outlet and in an upper position in the casing 40. Although not shown in FIG. 3, the indoor unit fan 12 is arranged behind the second opening 42 as the inlet and in a lower position in the casing 40. The first opening 41 as the outlet may be arranged in a different place, for example, in an upper surface or the like of the casing 40.

In the casing 40, an air course is formed that passes from the first opening 41 as the inlet through the indoor unit fan 12 and the refrigerant circuit 31 to the second opening 42 as the outlet. In other words, an air course that provides communication between the first opening 41 and the second opening 42 is formed in the casing 40. The refrigerant circuit 31 is provided in the air course. As described above, the refrigerant circuit 31 is filled with the refrigerant having a higher concentration than air under atmospheric pressure.

Further, the casing 40 has a third opening 43 that provides communication between the air course formed in the casing 40 and the outside of the casing 40. Also with reference to FIGS. 4 to 6, the third opening 43 will be described in detail. The third opening 43 is arranged below the refrigerant circuit 31. Further, the third opening 43 is positioned so that a lower edge of the third opening 43 is located below lower edges of the first opening 41 and the second opening 42.

Also, more preferably, the third opening 43 is positioned so that an upper edge of the third opening 43 rather than the lower edge of the third opening 43 is located below the lower edges of the first opening 41 and the second opening 42. The third opening 43 illustrated in FIG. 3 is provided in a position where the upper edge of the third opening 43 is located below the lower edge of the second opening 42 that is located below the first opening 41. The third opening 43 may be provided in a surface other than the front surface of the casing 40, for example, a side surface or the like.

The third opening 43 may be provided as an assembly of a plurality of openings. FIG. 5 illustrates third openings 43 consisting of three congruent rectangular openings. In this example in FIG. 5, laterally elongated three openings are vertically arranged to configure the third openings 43.

FIG. 6 illustrates third openings 43 consisting of a plurality of circular openings. In this example in FIG. 6, a plurality of circular openings having the same diameter are staggered to configure the third openings 43. The specific configuration of the third opening 43 is not limited to such examples. For example, the third opening may consist of one opening. Also, for example, a plurality of openings having the same shape may be arranged in a grid pattern.

As shown in FIG. 4, a first guide plate **44*a* is provided in the third opening 43. The first guide plate 44*a* is provided to protrude inward of the casing 40 from a lower edge of each of the plurality of openings that constitute the third openings 43. The first guide plate 44*a* includes a first guide surface extending vertically upward from inside toward outside of the casing 40. In other words, the first guide surface of the first guide plate 44*a* is inclined upward to the horizontal from inside toward outside of the casing 40. The first guide surface may be a curved surface rather than a plane. The first guide surface of the first guide plate 44*a* constitutes diffusion means for diffusing the refrigerant leaking from the refrigerant circuit 31 and flowing from the air course through the third opening 43 out of the casing 40**.

A case is considered where the refrigerant leaks from the refrigerant circuit 31 in the casing 40 of the indoor unit 10 in the refrigeration cycle device configured as described above. As described above, the refrigerant used here has a higher concentration than air under atmospheric pressure. Thus, the refrigerant has a property of falling down in air under atmospheric pressure. Therefore, in such a case, as shown in FIGS. 3 and 4, the refrigerant leaking from the refrigerant circuit 31 flows downward through the air course in the casing 40 as shown by an arrow of a flow 61 of the leaking refrigerant.

The refrigerant having reached the bottom of the air course then flows forward or backward or to right or left. The air course in the casing 40 communicates with the outside of the casing 40 through the first opening 41 and the second opening 42 as the inlet and the outlet as well as the third opening 43. At least the lower edge of the third opening 43 is arranged vertically below the lower edges of the first opening 41 and the second opening 42. Thus, the refrigerant having reached the bottom of the air course first flows through the third opening 43 out of the casing 40.

Then, when the refrigerant flows through the third opening 43 out of the casing 40, the first guide surface of the first guide plate **44*a* as the diffusion means diffuses the refrigerant. More specifically, as shown in FIG. 4, the refrigerant flowing through the third opening 43 out of the casing 40 is guided by the first guide surface of the first guide plate 44*a* and discharged from the casing 40 with a vertically upward velocity component. Since the refrigerant has a property of falling down, the refrigerant flows as it is, for example, along the floor surface of the room even without the first guide plate 44*a*. However, by action of the first guide plate 44*a*, the refrigerant is diffused vertically upward when flowing out (a refrigerant diffusion direction 62 in FIGS. 3 and 4**).

Here, the first guide plate **44*a* having the first guide surface directed upward to the horizontal is provided as the diffusion means. However, an opening surface itself of the third opening 43 may be provided to be directed upward to the horizontal so that the third opening 43** itself functions as the diffusion means.

The refrigeration cycle device configured as described above includes: the casing 40 having the first opening 41 and the second opening 42, one of which is the inlet and the other of which is the outlet, and having therein the air course providing communication between the first opening 41 and the second opening 42; and the refrigerant circuit 31 provided in the air course in the casing 40 and filled with the refrigerant having a higher concentration than air under atmospheric pressure. The casing 40 also has the third opening 43 providing communication between the air course and the outside of the casing 40, and the third opening 43 is arranged below the refrigerant circuit 31 and so that the lower edge of the third opening 43 is located below the lower edges of the first opening 41 and the second opening 42. The refrigeration cycle device also includes the first guide surface of the first guide plate 44*a* as the diffusion means for diffusing the refrigerant leaking from the refrigerant circuit 31 and flowing from the air course through the third opening 43 out of the casing 40.

Thus, even if the refrigerant leaks from the refrigerant pipe or the like in the casing of the refrigeration cycle device in a nonenergized state and the leaking refrigerant flows out of the casing, a region having a certain refrigerant concentration or higher can be prevented from being formed.

Embodiment 2

Figure 7:
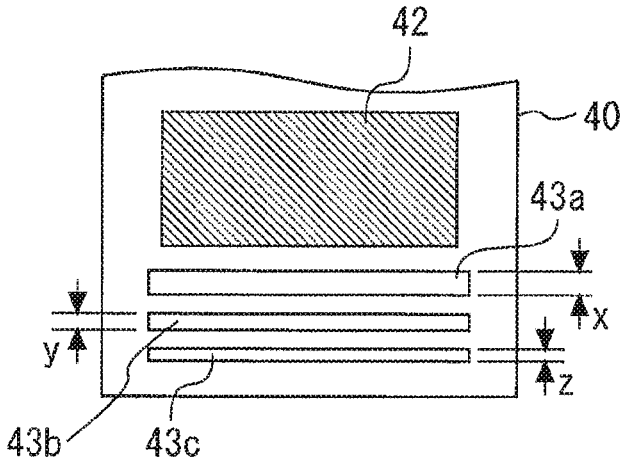
FIG. 7 shows an indoor unit of an air conditioner as an example of a refrigeration cycle device related to Embodiment 2 of the present invention and corresponds to FIG. 5.
Figure 8:
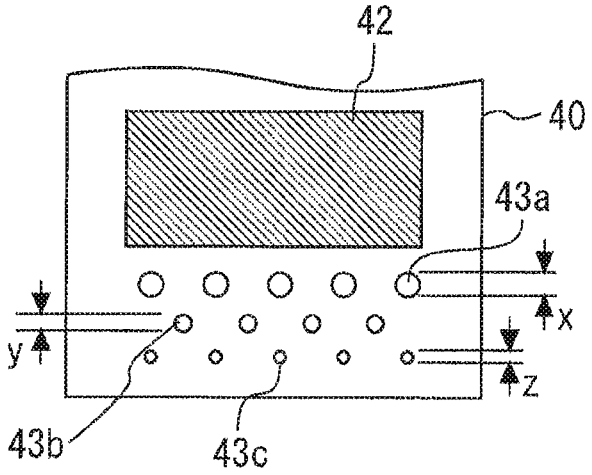
FIG. 8 shows the indoor unit of the air conditioner as an example of the refrigeration cycle device related to Embodiment 2 of the present invention and corresponds to FIG. 6.

FIGS. 7 and 8 relate to Embodiment 2 of the present invention, and FIG. 7 shows an indoor unit of an air conditioner as an example of a refrigeration cycle device and corresponds to FIG. 5, and FIG. 8 shows the indoor unit of the air conditioner as an example of the refrigeration cycle device and corresponds to FIG. 6.

Embodiment 2 described here is such that a plurality of third openings are provided, and an area of an opening in a relatively vertically lower position is smaller than an area of an opening in a relatively vertically upper portion in the configuration of Embodiment 1 described above.

First, with reference to FIG. 7, a first example of Embodiment 2 will be described. FIG. 7 is a front view of essential portions of a casing 40 of an indoor unit 10 of an air conditioner. As shown in FIG. 7, third openings 43 consist of three laterally elongated rectangular openings. The three openings are vertically arranged. Here, the three openings are a third opening (top) 43*a*, a third opening (middle) 43*b*, and a third opening (bottom) 43*c* from the top.

A vertical dimension of the third opening (top) 43*a* is x, a vertical dimension of the third opening (middle) 43*b* is y, and a vertical dimension of the third opening (bottom) 43*c* is z. In this case, x is larger than y, and y is larger than z. Specifically, x, y and z have the following relationship.

$$x>y>z$$

For these dimensions, specifically for example, x may be 10 mm, y may be 5 mm, and z may be 2 mm, or the like.

Lateral dimensions of the third opening (top) 43*a*, the third opening (middle) 43*b*, and the third opening (bottom) 43*c* are equal. Thus, the third opening (top) 43*a*, the third opening (middle) 43*b*, and the third opening (bottom) 43*c* are formed so that the area of the opening in the relatively lower position is smaller than the area of the opening in the relatively upper portion.

Next, with reference to FIG. 8, a second example of Embodiment 2 will be described. Like FIG. 7, FIG. 8 is a front view of essential portions of the casing 40 of the indoor unit 10 of the air conditioner. As shown in FIG. 8, third openings 43 consist of a plurality of staggered circular openings. The plurality of openings are vertically arranged in three rows. Here, for these opening groups in three rows, an opening group in the first row is a third opening (top) 43*a*, an opening group in the second row is a third opening (middle) 43*b*, and an opening group in the third row is a third opening (bottom) 43*c* from the top.

A diameter of one opening that constitutes the third opening (top) 43*a* is x, a diameter of one opening that constitutes the third opening (middle) 43*b* is y, and a diameter of one opening that constitutes the third opening (bottom) 43*c* is z. In this case, x is larger than y, and y is larger than z. Specifically, x, y and z have a relationship of x>y>z as in the first example.

In this second example, the third openings 43 are arranged vertically and also laterally. However, the openings in the lateral direction belong to the same opening group among the third opening (top) 43*a*, the third opening (middle) 43*b*, and the third opening (bottom) 43*c*. The openings are formed so that a sum of areas of the openings in the opening group in a relatively lower position is smaller than areas of the openings in a relatively upper position. FIG. 8 particularly shows a case where the areas of the openings in the same opening group, that is, the areas of the laterally arranged openings are equal. Specifically, in this case, the diameters of the laterally arranged openings are equal to each other, and the openings arranged in the vertical direction have different diameters (x, y and z). As long as the opening groups have different sums of areas of the openings, the areas of the openings in each opening group need not be always equal. However, in this case, horizontal positions of lower ends and upper ends of the openings in each opening group must be equal.

As such, in Embodiment 2, the plurality of third openings 43 are at least vertically provided. For the third opening (top) 43*a*, the third opening (middle) 43*b*, and third opening (bottom) 43*c* as the plurality of third openings 43, the sum of areas of the openings in the opening group in the relatively lower position is smaller than the sum of areas of the openings in the opening group in the relatively upper position. Other configurations are the same as in Embodiment 1, and detailed descriptions thereof will be omitted.

A case is considered where the refrigerant leaks from the refrigerant circuit 31 in the casing 40 of the indoor unit 10 in the refrigeration cycle device configured as described above. As described above, the refrigerant used here has a higher concentration than air under atmospheric pressure. Thus, the refrigerant has a property of falling down in air under atmospheric pressure. Therefore, in such a case, as shown in FIGS. 3 and 4 in Embodiment 1, the refrigerant leaking from the refrigerant circuit 31 vertically flows downward through the air course in the casing 40 as shown by the arrow of the flow 61 of the leaking refrigerant.

The refrigerant having reached the bottom of the air course first flows through the third openings 43 out of the casing 40 rather than flows through the first opening 41 and the second opening 42 as described in Embodiment 1. Here, the third openings 43 consisting of the plurality of openings at least vertically arranged are formed so that the area of the opening in the relatively lower position is smaller than the area of the opening in the relatively upper position.

Thus, the refrigerant in the lower position having a relatively higher concentration flows through the third opening (bottom) 43*c* having a smaller opening area out of the casing 40. On the other hand, the refrigerant in the upper position having a relatively lower concentration flows through the third opening (top) 43*a* having a larger opening area out of the casing 40. The refrigerant flowing out through the third opening (middle) 43*b* in the middle seems to have an intermediate concentration between the concentrations of the refrigerant flowing through the third opening (top) 43*a* and the third opening (bottom) 43*c*.

Thus, since an amount of refrigerant flowing out through the opening in the lower position close to the floor surface among the third openings 43 can be reduced, amounts of refrigerant flowing out through the third openings 43 can be vertically equalized. When the refrigerant having a higher concentration than air under atmospheric pressure leaks from the refrigerant circuit, the refrigerant vertically flows downward in the indoor unit, flows along a bottom surface of the indoor unit, and is discharged through the third opening 43 into the room.

In particular, if a velocity of the refrigerant leaking from the refrigerant circuit 31 is high (for example, 10 kg/h), a velocity of a flow of the leaking refrigerant at the bottom of the air course is also high. If a large amount of refrigerant flows out at the high flow velocity through the opening in the lower position among the third openings 43, the leaking refrigerant may collect in the lower position to locally increase the refrigerant concentration. In the refrigeration cycle device according to Embodiment 2, as described above, the amount of refrigerant flowing out through the third openings 43 can be vertically equalized, which effectively prevents the leaking refrigerant from locally collecting in such a case.

Embodiment 3

Figure 9:
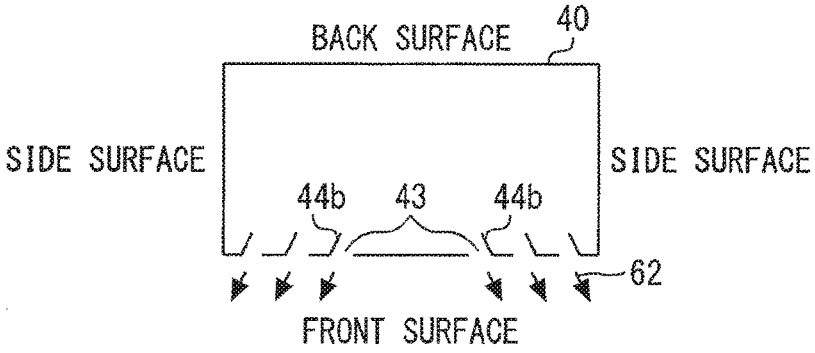
FIG. 9 is a sectional view of essential portions of an indoor unit of an air conditioner as an example of a refrigeration cycle device related to Embodiment 3 of the present invention seen from above.
Figure 10:
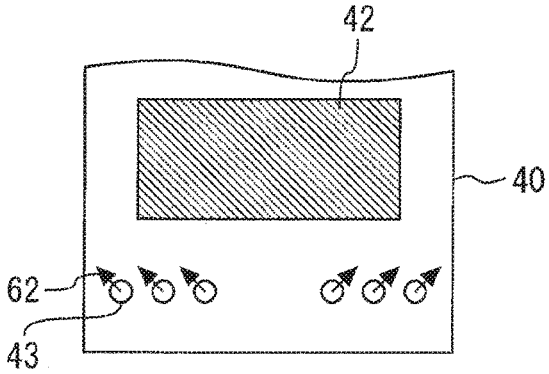
FIG. 10 is a front view of essential portions of the indoor unit of the air conditioner as an example of the refrigeration cycle device related to Embodiment 3 of the present invention.

FIGS. 9 and 10 relate to Embodiment 3 of the present invention, FIG. 9 is a sectional view of essential portions of an indoor unit of an air conditioner as an example of a refrigeration cycle device seen from above, and FIG. 10 is a front view of essential portions of the indoor unit of the air conditioner as an example of the refrigeration cycle device.

Embodiment 3 described here is such that a second guide surface extending laterally outward from inside toward outside of a casing is provided as diffusion means in a third opening in the configuration of Embodiment 1 or 2 described above.

FIG. 9 shows a section of a casing 40 of an indoor unit 10 according to Embodiment 3 cut along the horizontal including third openings 43. FIG. 10 is a front enlarged view of a part including the third openings 43 in the casing 40 of the indoor unit 10 according to Embodiment 3. As shown in FIGS. 9 and 10, in Embodiment 3, the third openings 43 consist of a plurality of circular openings having the same diameter.

The plurality of openings that constitute the third openings 43 are provided in positions closer to laterally outer sides in a front surface of the casing 40, rather than in a laterally middle position in the front surface. Here, a direction approaching a lateral center in the front surface of the casing 40 is referred to as "inward direction", while a direction apart from the lateral center in the front surface of the casing 40 is referred to as "outward direction".

As shown in FIG. 9, a second guide plate 44*b* is provided in the third opening 43. The second guide plate 44*b* is provided to protrude inward of the casing 40 from an edge of each of the plurality of openings that constitute the third openings 43. The second guide plate 44*b* has a second guide surface that extends laterally outward from inside toward outside of the casing 40. In other words, the second guide surface of the second guide plate 44*b* is inclined laterally outward to the front from inside toward outside of the casing 40. The second guide surface may be a curved surface rather than a plane. The second guide surface of the second guide plate 44*b* constitutes diffusion means for diffusing a refrigerant leaking from a refrigerant circuit 31 and flowing from the air course through the third openings 43 out of the casing 40.

As the diffusion means, only such a second guide plate 44*b* may be provided, or both the first guide plate 44*a* described in Embodiment 1 and the second guide plate 44*b* may be provided. Also, the guide surface may be inclined upward to the horizontal and laterally outward to the front from inside toward outside of the casing 40. Further, it is only necessary that the diffusion means directs the flow of the refrigerant in directions other than forward.

Further, FIGS. 9 and 10 show an example of the casing 40 according to Embodiment 3, and the third opening 43 may have a shape other than that shown here. Other configurations are similar to those in Embodiment 1 or 2, and detailed descriptions thereof will be omitted.

If the refrigerant leaks from the refrigerant circuit 31 in the casing 40 of the indoor unit 10 in the refrigeration cycle device configured as described above, the refrigerant first flows through the third opening 43 out of the casing 40 rather than flows through the first opening 41 and the second opening 42 as described in Embodiment 1. In this case, the second guide surface of the second guide plate 44*b* as the diffusion means diffuses the refrigerant.

More specifically, as shown by an arrow in a refrigerant diffusion direction 62 in FIGS. 9 and 10, the refrigerant flowing through the third opening 43 out of the casing 40 is guided by the second guide surface of the second guide plate 44*b* and discharged from the casing 40 with a laterally outward velocity component. Thus, Embodiment 3 can achieve the same advantage as Embodiment 1 or 2, and the refrigerant discharged through the third opening 43 into the room when leaking can be diffused and released to prevent a refrigerant concentration in a front portion of the indoor unit 10 from locally increasing.

Embodiment 4

Figure 11:
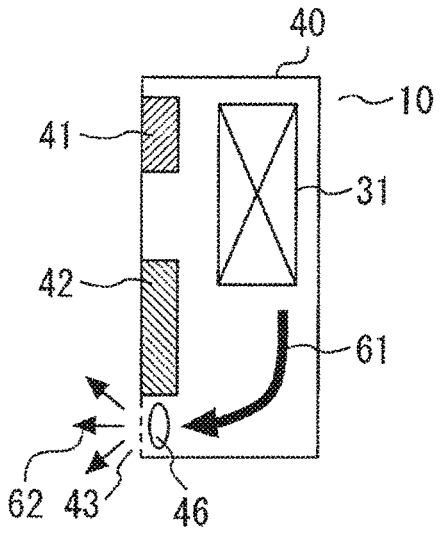
FIG. 11 is a sectional view of an indoor unit of an air conditioner as an example of a refrigeration cycle device related to Embodiment 4 of the present invention seen from the side.
Figure 12:
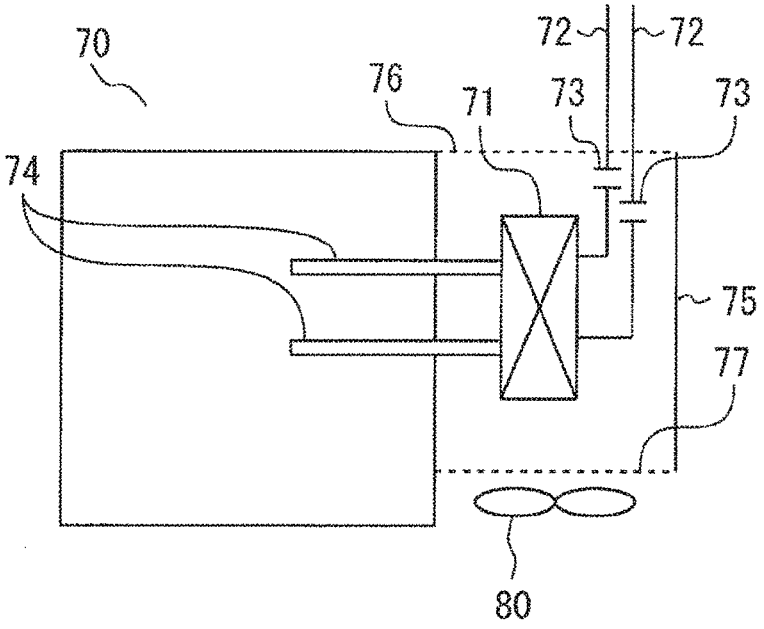
FIG. 12 shows a configuration of essential portions of a water heater as another example of the refrigeration cycle device related to Embodiment 4 of the present invention.

FIGS. 11 and 12 relate to Embodiment 4 of the present invention, FIG. 11 is a sectional view of an indoor unit of an air conditioner as an example of a refrigeration cycle device seen from the side, and FIG. 12 shows a configuration of essential portions of a water heater as another example of the refrigeration cycle device.

Embodiment 4 described here is such that a rotor that is rotatable by a flow of a refrigerant leaking from a refrigerant circuit is provided as diffusion means to face a third opening in the configuration of any of Embodiments 1 to 3 described above.

Specifically, as shown in FIG. 11, a rotor 46 is provided in a casing 40 of an indoor unit 10. The rotor 46 is arranged to face a third opening 43 in the casing 40. The rotor 46 can use, specifically for example, an axial flow propeller fan. The rotor 46 is mounted to be rotatable by flowing a refrigerant leaking from a refrigerant circuit 31 and passing through the rotor 46. The rotor 46 thus provided constitutes diffusion means for diffusing the refrigerant leaking from the refrigerant circuit 31 and flowing from the air course through the third opening 43 out of the casing 40.

A case is considered where the refrigerant leaks from the refrigerant circuit 31 in the casing 40 of the indoor unit 10 in the refrigeration cycle device configured as described above. As described above, the refrigerant having a property of falling down vertically flows downward through the air course in the casing 40 as shown by an arrow of a flow 61 of the leaking refrigerant in FIG. 11. Then, the refrigerant having reached the bottom of the air course first flows through the third opening 43 out of the casing 40 rather than flows through the first opening 41 and the second opening 42 as described in Embodiment 1.

Here, the rotor 46 is arranged to face the third opening 43, and is arranged on a flow path of the leaking refrigerant flowing through the third opening 43 out of the casing 40. Thus the flowing leaking refrigerant hits and pushes the rotor 46, and thus the rotor 46 is rotated. When the rotor 46 is rotated, the flow of the leaking refrigerant flowing through the third opening 43 out of the casing 40 is disturbed.

Thus, the rotor 46 as the diffusion means diffuses the refrigerant flowing through the third opening 43 out of the casing 40 as shown by an arrow of a refrigerant diffusion direction 62 in FIG. 11. Specifically, the flow 61 of the leaking refrigerant having a high concentration passes through the rotor 46, so that the refrigerant is mixed with air to have a low concentration, and is discharged through the third opening 43 out of the casing 40.

Other configurations are similar to those in Embodiment 1, and descriptions thereof will be omitted.

Next, FIG. 12 shows a configuration of a load unit of a heat pump water heater as another example of a refrigeration cycle device. The heat pump water heater includes a refrigerant circuit for circulating a refrigerant, and a water circuit for circulating water. The heat pump water heater includes a load unit installed in a room and a heat source unit installed, for example, outside the room. The load unit is provided, for example, in a kitchen or a bathroom, or a storage space such as a storage room inside a building.

With reference to FIG. 12, a configuration of the load unit of the heat pump water heater will be described. The load unit 70 of the heat pump water heater includes a load side heat exchanger 71 that performs heat exchange between a refrigerant flowing through the refrigerant circuit and water flowing through the water circuit. The load side heat exchanger 71 is connected via a load side metal joint 73 to a refrigerant flow path 72 connecting to a heat source unit side. One end side of a water flow path 74 is connected to the load side heat exchanger 71. The other end side of the water flow path 74 is connected to the water circuit. A detailed configuration of the water circuit is not shown.

The load side heat exchanger 71 and the load side metal joint 73 are housed in a heat exchanger chamber 75. The heat exchanger chamber 75 corresponds to the casing 40 in the example of the indoor unit 10 described above. A load unit inlet 76 is formed in an upper portion of the heat exchanger chamber 75 and above the load side heat exchanger 71 and the load side metal joint 73. A load unit outlet 77 is formed in a lower portion of the heat exchanger chamber 75 and below the load side heat exchanger 71 and the load side metal joint 73.

A load unit rotor 80 is installed further below the load unit outlet 77. The load unit rotor 80 corresponds to the rotor 46 in the example of the indoor unit 10 described above. Specifically, the load unit rotor 80 constitutes diffusion means for diffusing a refrigerant leaking from the load side heat exchanger 71 and the load side metal joint 73 or the like and flowing through the load unit outlet 77.

This example of the heat pump water heater is different from the example of the indoor unit 10 described above in that no third opening is provided and that the load unit rotor 80 is provided outside the heat exchanger chamber 75. However, these examples use a rotor as diffusion means for diffusing a leaking refrigerant in common, and an application of such a rotor is described here.

A case is considered where a refrigerant leaks from the load side heat exchanger 71 and the load side metal joint 73 or the like in the heat exchanger chamber 75 in the heat pump water heater thus configured. The refrigerant used here also has a higher concentration than air under atmospheric pressure and has a property of falling down in air under atmospheric pressure. Thus, in such a case, the leaking refrigerant flows downward in the heat exchanger chamber 75 and flows from the load unit outlet 77 out of the heat exchanger chamber 75.

Then, the refrigerant having flowed through the load unit outlet 77 out of the heat exchanger chamber 75 hits and rotates the load unit rotor 80. When the load unit rotor 80 is rotated, the flow of the leaking refrigerant flowing through the load unit outlet 77 out of the heat exchanger chamber 75 is disturbed. Specifically, the leaking refrigerant having a high concentration and having flowed through the load unit outlet 77 passes through the load unit rotor 80, so that the refrigerant is mixed with air to have a low concentration, and is diffused.

With the rotor 46 as the diffusion means, the refrigeration cycle device configured as described above can achieve the same advantage as Embodiment 1 or the like described above. The rotor 46 may be combined with one or both of the first guide plate 44*a* and the second guide plate 44*b* described above as diffusion means to achieve a synergistic effect.

Embodiment 5

Figure 13:
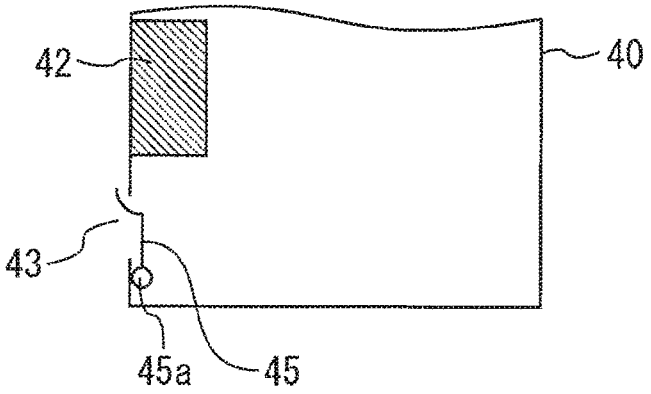
FIG. 13 is an example of sectional view of essential portions of an indoor unit of an air conditioner as an example of a refrigeration cycle device related to Embodiment 5 of the present invention seen from the side
Figure 14:
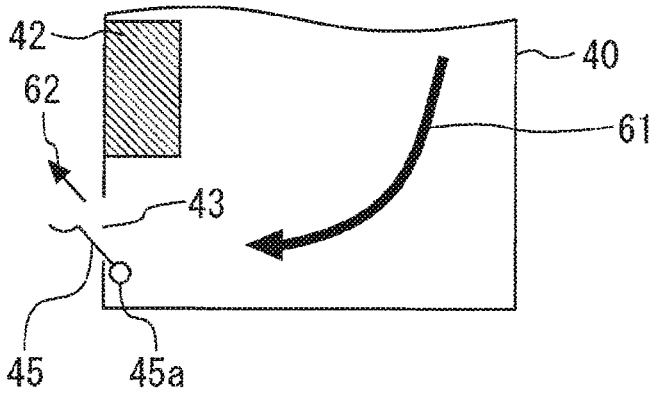
FIG. 14 is the example of sectional view of essential portions of the indoor unit of the air conditioner as the example of the refrigeration cycle device related to Embodiment 5 of the present invention seen from the side
Figure 15:
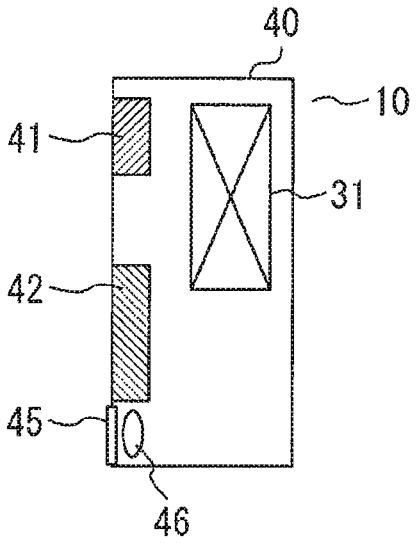
FIG. 15 is another example of sectional view of essential portions of the indoor unit of the air conditioner as an example of the refrigeration cycle device related to Embodiment 5 of the present invention seen from the side.
Figure 16:
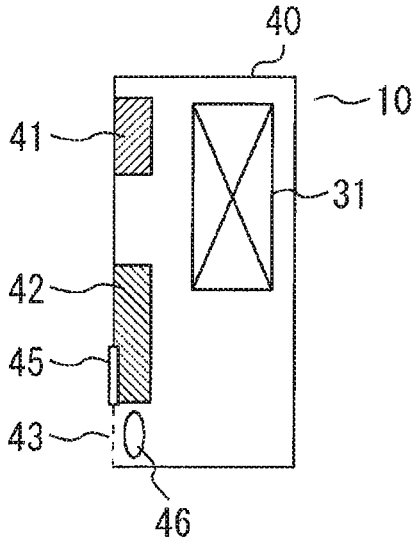
FIG. 16 is another example of sectional view of essential portions of the indoor unit of the air conditioner as the example of the refrigeration cycle device related to Embodiment 5 of the present invention seen from the side.

FIGS. 13 to 16 relate to Embodiment 5 of the present invention, FIGS. 13 and 14 are examples of sectional views of essential portions of an indoor unit of an air conditioner as an example of a refrigeration cycle device seen from the side, and FIGS. 15 and 16 are another examples of sectional views of essential portions of the indoor unit of the air conditioner as an example of the refrigeration cycle device seen from the side.

Embodiment 5 described here is such that a shutter for opening/closing a third opening is provided in the configuration of any of Embodiments 1 to 4 described above.

First, FIGS. 13 and 14 show a configuration in which the rotor in Embodiment 4 is not used as diffusion means, and a shutter itself can also function as the first guide plate 44*a* in Embodiment 1. A shutter 45 is provided in a third opening 43. The shutter 45 is supported by a shaft 45*a* provided inside a casing 40 at a lower edge of the third opening 43.

In normal times, the shutter 45 is arranged in a position shown in FIG. 13. In this position, the shutter 45 closes the third opening 43. As described above, the third opening 43 provides communication between the air course in the casing 40 and the outside of the casing 40 apart from a first opening 41 and a second opening 42. Here, the third opening 43 is arranged upstream of an indoor unit fan 12 in the air course.

Thus, during operation of the indoor unit fan 12, negative pressure generated by the indoor unit fan 12 sucks the shutter 45 toward the air course in the casing 40. Thus, the shutter 45 is held in the position to close the third opening 43 shown in FIG. 13.

On the other hand, during stop of the indoor unit fan 12, no force to suck the shutter 45 toward the air course in the casing 40 is generated. In this state, if the refrigerant leaks from the refrigerant circuit 31 in the casing 40 of the indoor unit 10, the refrigerant having a property of falling down travels downward in the casing 40 as shown by an arrow of a flow 61 of the leaking refrigerant in FIG. 14.

Then, the refrigerant having reached the bottom of the casing 40 travels horizontally along the bottom of the casing 40 and pushes the shutter 45 from inside toward outside of the casing 40, and the shutter 45 is placed in the position shown in FIG. 14 to open the third opening 43. Thus, the refrigerant flows through the opened third opening 43 out of the casing 40.

In this case, the shutter 45 pivots around the shaft 45*a* at the lower end, abuts against the lower edge of the third opening 43, and stops pivoting in the position shown in FIG. 14. In this state, the shutter 45 is inclined upward to the horizontal from inside toward outside of the casing 40. Specifically, a side of the shutter 45 inside the casing 40 is arranged similarly to the first guide surface of the first guide plate 44*a* in Embodiment 1. Thus, the shutter 45 also functions as diffusion means similar to the first guide plate 44*a* in the Embodiment 1.

The shutter 45 may simply open/close the third opening 43, and as in an example described below, any of the first guide plate 44*a*, the second guide plate 44*b*, and the rotor 46 described in Embodiments 1, 3 and 4 or a combination thereof may be used as diffusion means.

Next, with reference to FIGS. 15 and 16, another example of Embodiment 5 will be described. FIGS. 15 and 16 show the rotor in Embodiment 4 being used as diffusion means. A shutter 45 is provided in the third opening 43. The shutter 45 vertically slides to be movable between a position shown in FIG. 15 and a position shown in FIG. 16. Although there is no need to energize the shutter 45 in FIGS. 13 and 14, the shutter 45 in FIGS. 15 and 16 is energized to move. There is no need to energize the shutter 45 in order to maintain the shutter 45 in a position after movement in FIGS. 15 and 16.

When a product is operated (when the refrigerant circuit 31 is operated), the shutter 45 is in the position shown in FIG. 15 and closes the third opening 43. When the operated product is stopped (when the refrigerant circuit 31 is stopped), the shutter 45 moves to the position shown in FIG. 16 to open the third opening 43, and then maintain the third opening 43 open even in a nonenergized state. When the stopped product is restarted, the shutter 45 moves to the position shown in FIG. 15. Specifically, the opening 43 is always open during stop of the product, while the opening 43 is closed during operation of the product. The state in FIG. 16 is the same as the state in FIG. 11 of Embodiment 4 described above. Thus, in this state, if the refrigerant leaks from the refrigerant circuit 31 in the casing 40 of the indoor unit 10, the rotor 46 as the diffusion means can diffuse the refrigerant flowing through the third opening 43 out of the casing 40.

In any examples of Embodiment 5 described above, other configurations are similar to those in Embodiment 1, and descriptions thereof will be omitted.

The refrigeration cycle device configured as described above can achieve the same advantage as any of Embodiments 1 to 4 described above. In addition, at normal times or during operation of the refrigerant circuit 31, the shutter 45 can close the third opening 43 communicating with the air course in the casing 40 to prevent pressure loss in the air course.

Embodiment 6

Figure 17:
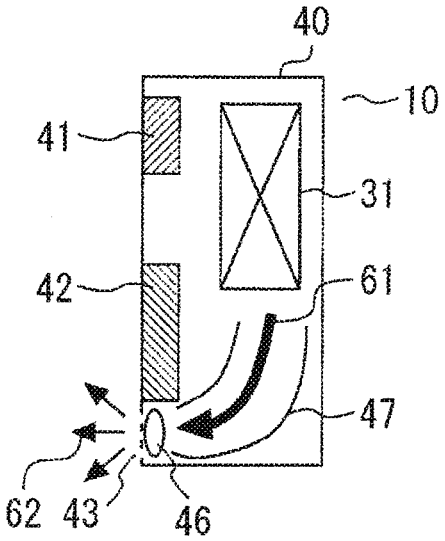
FIG. 17 is a sectional view of an indoor unit of an air conditioner as an example of a refrigeration cycle device related to Embodiment 6 of the present invention seen from the side.

FIG. 17 relates to Embodiment 6 of the present invention, and is a sectional view of an indoor unit of an air conditioner as an example of a refrigeration cycle device seen from the side.

Embodiment 6 described here is such that a guidepath is provided in a casing in the configuration of any of Embodiments 1 to 5 described above.

Specifically, as shown in FIG. 17, a guidepath 47 is provided in a casing 40. The guidepath 47 is provided in a smooth curve from below a refrigerant circuit 31 toward just before a third opening 43. In the example in FIG. 17, the rotor 46 in Embodiment 4 is provided as diffusion means. Thus, more precisely, the guidepath 47 is provided from vertically below the refrigerant circuit 31 toward just before the rotor 46.

In the refrigeration cycle device thus configured, a refrigerant having leaked from the refrigerant circuit 31 in the casing 40 and having a property of falling down is guided by the guidepath 47 to the third opening 43. Thus, the refrigerant quickly reaches the third opening 43 after leaking, and the diffusion means can diffuse the leaking refrigerant. Also, the leaking refrigerant can be prevented from flowing through openings other than the third opening 43 out of the casing 40, thereby maximizing a capability of the diffusion means.

The shape of the guidepath 47 is not limited to that illustrated in FIG. 17, but may be such a shape that does not hinder an air conditioning operation in normal use, that is, that does not hinder an airflow in the air course.

Other configurations are similar to those in any of Embodiments 1 to 5, and descriptions thereof will be omitted.

INDUSTRIAL APPLICABILITY

The present invention can be used in a refrigeration cycle device including a casing that houses a refrigerant circuit filled with a refrigerant having a higher concentration than air under atmospheric pressure, specifically for example, a refrigeration cycle device in an indoor unit and an outdoor unit of a floor-type, ceiling-mounted, or wall-mounted air conditioner, a water heater, a showcase, and a refrigerator, or the like.

DESCRIPTION OF SYMBOLS

10 Indoor Unit, 11 Indoor Unit Heat Exchanger, 12 Indoor Unit Fan, 13 indoor unit metal joint, 20 Outdoor Unit, 21 Outdoor Unit Heat Exchanger, 22 Outdoor Unit Fan, 23 Four-Way Valve, 24 Compressor, 25 Expansion Valve, 26 Outdoor Unit Metal Joint, 30 Refrigerant Pipe, 31 Refrigerant Circuit, 40 Casing, 41 First Opening, 42 Second Opening, 43 Third Opening, 43*a* Third Opening (Top), 43*b* Third Opening (Middle), 43*c* Third Opening (Bottom), 44*a* First Guide Plate, 44*b* Second Guide Plate, 45 Shutter, 45*a* Shaft, 46 Rotor, 47 Guidepath, 50 Electronic Circuit Substrate, 61 Flow of Leaking Refrigerant, 62 Refrigerant Diffusion Direction, 70 Load Unit, 71 Load Side Heat Exchanger, 72 Refrigerant Flow Path, 73 Load Side Metal Joint, 74 Water Flow Path, 75 Heat Exchanger Chamber, 76 Load Unit Inlet, 77 Load Unit Outlet, 80 Load Unit Rotor

The invention claimed is:

1. A refrigeration cycle device comprising:

a casing having a first opening and a second opening, one of which is an inlet and the other of which is an outlet, and having therein an air course providing communication between the first opening and the second opening; and a refrigerant circuit provided in the air course in the casing and filled with a refrigerant having a higher concentration than air under atmospheric pressure, the casing having a third opening providing communication between the air course and outside of the casing, the third opening being arranged below the refrigerant circuit, and a lower edge of the third opening being located below lower edges of the first opening and the second opening, a plurality of the third openings are at least vertically arranged, and for the plurality of the third openings, a total area of an opening group in a relatively vertically lower position is smaller than a total area of an opening group in a relatively vertically upper position.

2. The refrigeration cycle device according to claim 1, wherein the third opening is arranged below the refrigerant circuit, and an upper edge of the third opening is arranged below the lower edges of the first opening and the second opening.

3. The refrigeration cycle device according to claim 1, comprising a first guide surface provided in the third opening and extending upward from inside toward outside of the casing.

4. The refrigeration cycle device according to claim 1, comprising a second guide surface provided in the third opening and extending along a direction apart from a lateral center in the front surface of the casing from inside toward outside of the casing.

5. The refrigeration cycle device according to claim 1, comprising a rotor provided to face the third opening and rotatable by passage of the refrigerant leaking from the refrigerant circuit.

6. The refrigeration cycle device according claim 1, comprising a shutter for opening/closing the third opening.

7. The refrigeration cycle device according to claim 6, wherein the shutter closes the third opening at normal times, and opens the third opening by the refrigerant leaking from the refrigerant circuit hitting the shutter.

8. The refrigeration cycle device according to claim 6, wherein the shutter closes the third opening during operation of the refrigerant circuit, and opens the third opening during stop of the refrigerant circuit.

9. The refrigeration cycle device according to claim 1, comprising a guidepath provided in the casing and guiding the refrigerant leaking from the refrigerant circuit to the third opening.

10. The refrigeration cycle device according to claim 1, wherein the refrigerant is flammable.

11. The refrigeration cycle device according to claim 1, wherein the casing is a casing of a floor-type indoor unit of an air conditioner.

12. A refrigeration cycle device comprising:

a casing having a first opening and a second opening configured as an inlet and an outlet of an air course which provides communication between the first opening and the second opening;

a refrigerant circuit provided in the air course in the casing and filled with a refrigerant having a higher concentration than air under atmospheric pressure, and the casing including a plurality of third openings providing communication between the air course and outside of the casing, the third openings being arranged vertically below the refrigerant circuit and a lower edge of the third openings being located below lower edges of the first opening and the second opening, wherein the plurality of third openings has a total open area in a relatively vertically lower position smaller than a total open area of an opening group in a relatively vertically upper position.

* * * * *